US008739325B2

(12) United States Patent
Ballestra

(10) Patent No.: US 8,739,325 B2
(45) Date of Patent: Jun. 3, 2014

(54) SHOWER UNIT COMPRISING A SHOWER RECEIVER AND A PUMPING DEVICE

(75) Inventor: Victor Jean Ballestra, Vauhallan (FR)

(73) Assignee: Societe Francaise d'Assainissement—SFA, Paris (FR)

( * ) Notice: Subject to any disclaimer, the term of this patent is extended or adjusted under 35 U.S.C. 154(b) by 454 days.

(21) Appl. No.: 13/132,543

(22) PCT Filed: Nov. 26, 2009

(86) PCT No.: PCT/FR2009/052313

§ 371 (c)(1),
(2), (4) Date: Aug. 2, 2011

(87) PCT Pub. No.: WO2010/063924

PCT Pub. Date: Jun. 10, 2010

(65) Prior Publication Data

US 2011/0289673 A1 Dec. 1, 2011

(30) Foreign Application Priority Data

Dec. 2, 2008 (FR) ..... 08 58191

(51) Int. Cl.
*A47K 3/00* (2006.01)

(52) U.S. Cl.
USPC ..... 4/613

(58) Field of Classification Search
USPC ..... 4/603, 612, 613
See application file for complete search history.

(56) References Cited

U.S. PATENT DOCUMENTS

| | | | | |
|---|---|---|---|---|
| 3,606,618 | A * | 9/1971 | Veech | 4/603 |
| 5,289,599 | A * | 3/1994 | Hintz et al. | 4/613 |
| 7,937,785 | B2 * | 5/2011 | Stimpson et al. | 4/665 |
| 2007/0277306 | A1 * | 12/2007 | Grooms et al. | 4/613 |
| 2010/0101014 | A1 * | 4/2010 | Stimpson | 4/613 |

FOREIGN PATENT DOCUMENTS

| | | |
|---|---|---|
| EP | 1 336 436 A1 | 8/2003 |
| FR | 2 823 234 A1 | 10/2002 |
| GB | 2 445 612 A | 7/2008 |
| GB | 2 449 265 A | 11/2008 |

OTHER PUBLICATIONS

International Search Report, dated Apr. 14, 2010, from corresponding PCT application.

* cited by examiner

*Primary Examiner* — Gregory Huson
*Assistant Examiner* — Christine Skubinna
(74) *Attorney, Agent, or Firm* — Young & Thompson

(57) ABSTRACT

A shower unit including a shower receiver (1) and a pumping device (2), whereby the shower receiver (1) includes a first portion (100) forming the shower tray and a second portion formed by a recess (120). The aforementioned pumping device (2) is positioned in the recess (120) of the receiver (1).

11 Claims, 2 Drawing Sheets

SHOWER UNIT COMPRISING A SHOWER RECEIVER AND A PUMPING DEVICE

Figure 1:
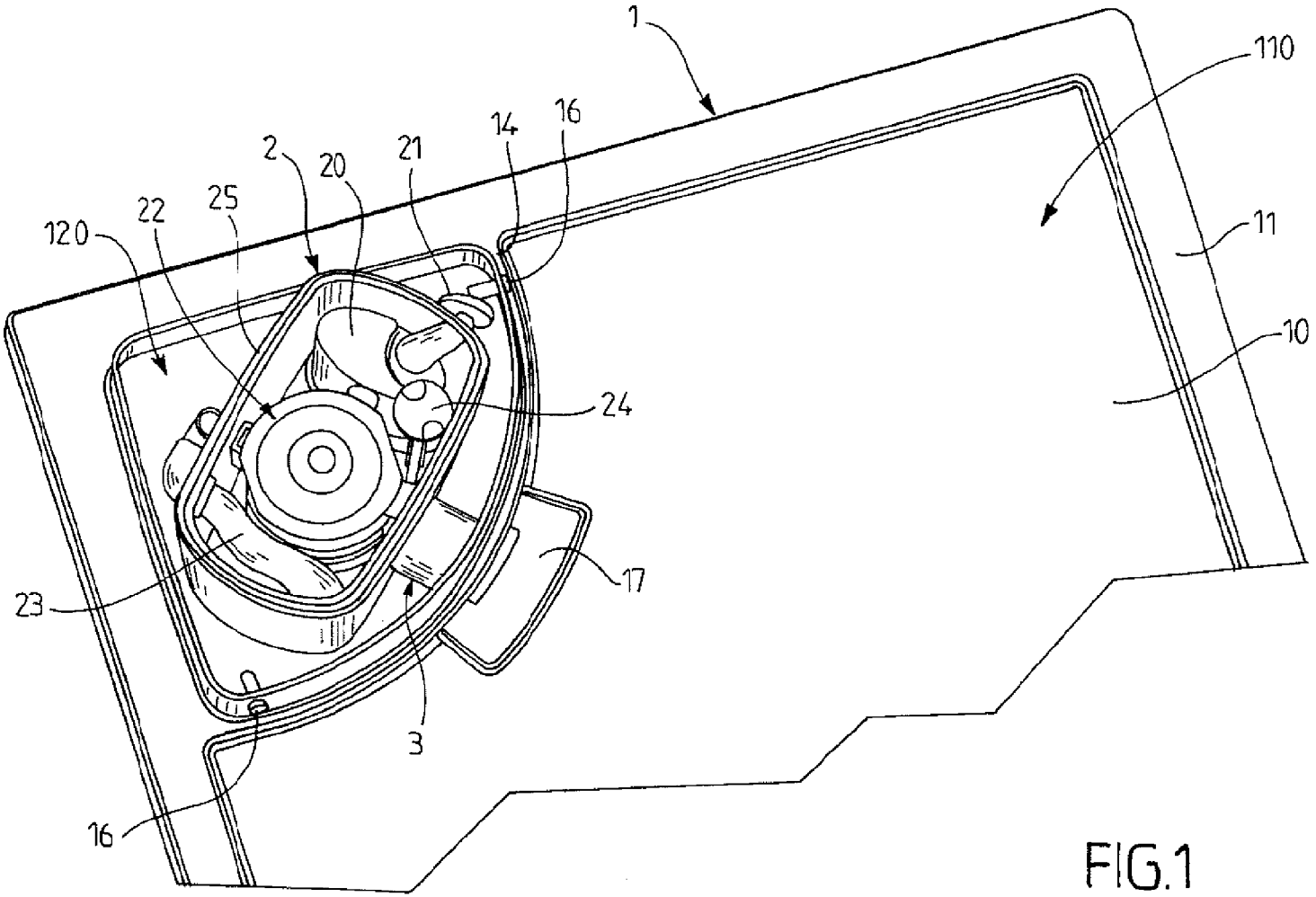

The present invention relates generally to a shower installation including a shower receiver connected to an evacuation pipe via a pumping device.

As known in itself, when installing a shower receiver, if it is not wished to excavate the floor, it is necessary to raise the bottom of the receiver about eight centimeters from the floor to leave room for the evacuation trap and the evacuation pipe.

As a result access to such installations by disabled persons in a wheelchair is generally impossible if they are not accompanied.

There are known shower installations in which the receiver is at floor level, said receiver consisting for example of part of the floor covered with waterproof material. Such shower installations, known as Italian style shower installations, are costly to install because they necessitate excavating the floor to enable installation of the receiver and the evacuation device.

Moreover, these installations cannot always be used since it is necessary for the floor to consist of a relatively thick slab that may be excavated to a depth of the order of five to ten centimeters without weakening it and without cutting into a water or electricity supply. This is why such installations are usually prohibited in apartment buildings and are often reserved for private houses in which bathrooms may be above a sanitation void or a cellar so that the evacuation pipe is situated below the slab in which the receiver is positioned.

When it is not possible to position the evacuation pipe under the slab, it is for example known to use a device for pumping out water in the receiver.

In known installations, the receiver includes a cavity connected to a pumping device. Said pumping device is activated by complex and costly means making it possible to detect opening of the door of the installation, for example, a drop in the pressure in the water supply pipes on opening the taps, or the presence of a person in the installation detected by an optical sensor.

The means most commonly used place electrodes in said cavity so as to close an electrical control circuit when the water present in the cavity establishes the continuity of the electrical circuit between said electrodes.

This type of installation is both costly and bulky because the pump is supplied at a voltage of 200 Volts and must therefore be disposed beside the receiver. As a result of this it is necessary to provide control cables connected to the electrodes and a water evacuation pipe between the receiver and said pump. Moreover, to the degree that the control electrodes of the pump are disposed in contact with the water in the receiver, it is essential to supply it at a voltage of 12 to 24 Volts and thus to use a safety transformer.

The present invention proposes to provide an installation projecting from the floor by only a few centimeters and consequently accessible to disabled persons in a wheelchair, at the same time as being easy to install because it necessitates no work to excavate the slab.

To this end, the invention concerns a shower installation including a shower receiver and a pumping device, characterized in that the shower receiver consists overall of a first part forming the shower tray and a second part consisting of a recess and in that said pumping device is disposed in said recess of said receiver.

The shower installation of the invention is further noteworthy in that:

- the pumping device consists of a pressure-sensitive switch, a pump and an outlet pipe,

- the pumping device is disposed in a casing closed by a lid,
- an outlet pipe is disposed between the tray and the casing of the pumping device,
- said outlet pipe is of oblong section and positioned with its smaller dimension perpendicular to the floor,
- the tray includes a cup the bottom of which is at a lower level than the bottom of said tray and which is connected to the casing of the pumping device by the outlet pipe,
- said outlet pipe consists of an outlet of the cup of the tray connected by a sleeve to an inlet of the casing,
- the recess is delimited by a wall disposed above the rim of the receiver,
- the recess is closed by a lid.

Figure 2:
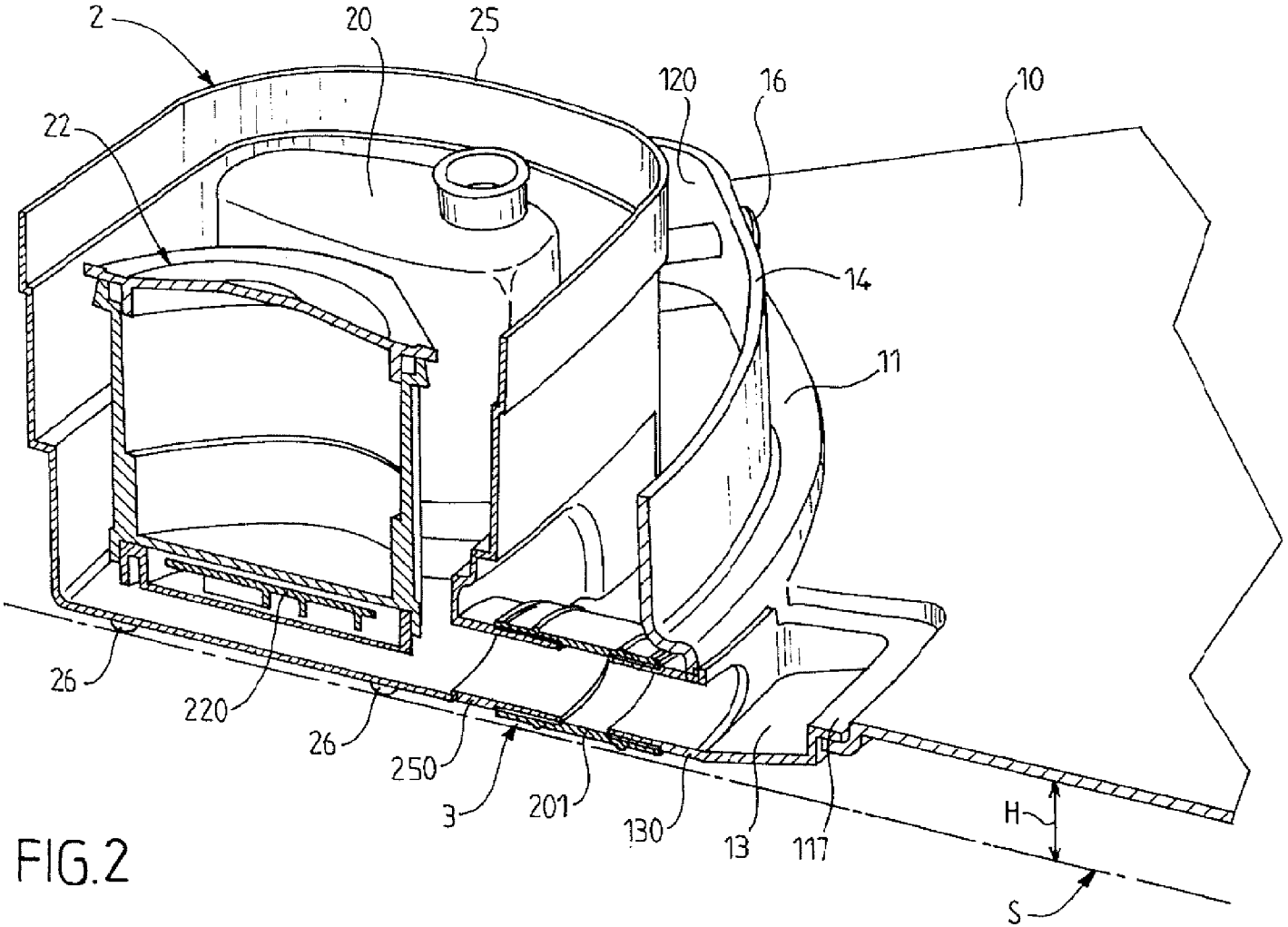

The invention will become clear in the light of the following description given by way of nonlimiting example and with reference to the appended drawings, in which:

FIG. 1 is a partial perspective view from above of an installation of the invention showing the receiver and the pumping device, the protective lid of which is not shown, FIG. 2 is a partial sectional perspective view showing more precisely the connection of the receiver to the pumping device.

As may be seen in the drawings, the installation of the invention consists overall of a shower receiver 1 and a pumping device 2 disposed in a recess 120 of the receiver 1 limited by a wall 14.

The shower receiver 1 used in the present invention consists overall of two parts: a first part 100 forming the shower tray in which the user is positioned and water flows and a second part constituting a recess 120 for placing the pumping device 2.

The shower receiver 1 consists in a manner known in itself of a bottom 10 and a rim 11 raised relative to the bottom 10, said rim extending along the external perimeter of the receiver 1 and along the wall 14 delimiting the recess 120 of the shower tray 100.

Said wall 14 extends above the rim 11 of the receiver 1 so that water present in the tray 100 cannot pass over said wall 14 and enter the recess 120.

To facilitate access for a disabled person, the bottom 10 of the receiver 1 is usually about three centimeters above the floor and the rim 11 of the receiver 1 is at a small distance from the bottom 10, for example a distance of the order of one centimeter.

With such an installation, an unaccompanied person in a wheelchair may enter the tray 100 of the shower receiver to carry out their ablutions, possibly using an access ramp the dimensions of which are smaller given the low height to be reached.

As will become clear later, the pumping device 2 is mechanically activated as function of the quantity of water present in the tray 100 of the shower receiver 1, no electrically conductive means being present between said shower tray 100 and the pumping device 2.

The pumping device 2 consists overall of a casing 25 that is closed by a lid that is not shown in the drawing and in which are disposed a pressure-sensitive switch 20, a pump 22 and an outlet pipe 23. To avoid overcomplicating the drawing, the components of the pump motor are not shown. The pump 22 is represented diagrammatically by its casing and the impeller 220.

In this pumping device 2, the water to be evacuated feeds into the casing 25 and when its level exceeds a prescribed threshold value the membrane at the base of the pressure-sensitive switch 20 is deformed and commands the supply of electrical power to the pump 22. The impeller 220 of said pump 22 is then driven in rotation so as to suck up the water present at the bottom of the casing 25 and discharge it into the outlet pipe 23.

The pumping device 2 is supplied with electrical power by an electrical cable that is not shown in the drawings, which passes through the wall of the casing 25 via a safety grommet 21.

Said electrical conductor is positioned in the casing 25 so that it cannot come into contact with the water and the pump is controlled by way of the membrane of the pressure-sensitive switch, which is not conductive.

The electrical power supply cable and the evacuation pipe to which the outlet pipe 23 is connected are disposed under the rim 11 of the shower receiver 1, for example.

Venting means 24 are represented diagrammatically in FIG. 1, for information purposes, whereas the lid of the casing 25 is not shown in order not to overcomplicate the drawing.

An outlet pipe 3 disposed between the tray 100 of the receiver 1 and the pumping device 2 conveys water present in the tray 100 to the casing 25 of the pumping device 2.

To this end, the tray 100 is conformed so that water flows toward a cup 13 the bottom of which is at a lower level than the bottom 10. Said cup 13 is for example a part placed in a cut-out of the receiver 1 as shown in the drawing, but may equally consist of any other means, for example being molded in one piece with said receiver 1.

For aesthetic reasons, and to prevent the passage of elements other than water from the tray 100 to the cup 13, the edge of the latter consists for example of a flat ledge 117 on which is placed a grille 17.

The cup 13 is connected to the casing 25 of the pumping device 2 by an outlet pipe 3.

In the embodiment represented in the drawing, said outlet pipe 3 is an outlet 130 fastened to the cup 13 of the receiver 1 connected by a sleeve 201 to an inlet 250 of the casing 25.

The device of the invention operates in the following manner:

when water flows into the tray 100 of the receiver, it is directed toward the cup 13 and then toward the casing 25 of the pumping device, the water level rises in the bottom of said casing 25 up to the threshold value at which the membrane of the pressure-sensitive switch 20 is moved and commands starting of the pump 22, the rotation of the impeller 220 of said pump 22 sucks up water that flows from the receiver 1 and discharges it toward the outlet pipe 23 which is connected to a gray water evacuation pipe in a manner that is not shown in the drawing.

According to one particular feature of the invention, the outlet pipe 3 is not of circular section, as is the norm, but of oblong section, longer than it is wide and consisting of two parallel rectilinear sides connected by rounded ends.

This feature makes it possible to provide a pipe allowing flow of the same flow rate of water as a pipe of circular section commonly used but which is advantageously much less bulky in one direction.

With said pipe 3 positioned with one of its plane faces constituting its larger dimension parallel to the floor and its smaller dimension perpendicular to the floor, as shown in the drawings, the height H between the bottom 10 of the receiver 1 and the floor S is significantly smaller, which makes it possible to lower said receiver to render it more easily accessible, especially to persons in a wheelchair.

Moreover, the components of the pumping device 2 have dimensions such that the water level necessary to activate the pump motor is low.

The features of the embodiment of the invention represented in the drawings make it possible to position the bottom 10 of the tray 100 of the receiver 1 three centimeters above the floor, or even slightly lower.

The casing 25 of the pumping device 2 is preferably fitted with feet 26 for damping vibrations occurring during operation of the pump 22.

A lid that is not represented in the drawings closes the recess 120 of the receiver in which the pumping device 2 is disposed. This cover may for example be shaped to serve as a seat or a footrest.

Said lid bears on the rim 11 of the receiver and is fixed to the wall 14 delimiting the recess 120 by fixing means such as screws 16.

Because the wall 14 is above the rim 11 of the receiver 1, water in the tray 100 cannot enter the recess 120 and flood the cavity below said receiver, which could cause damage.

Moreover, so as to remove the risk of water getting between the wall 14 and the lid by capillary action, the lateral wall of the lid is positioned at a distance from said wall 14 so as to leave a gap.

As will have become clear on reading the foregoing description illustrated by the appended drawings, the installation of the invention has numerous advantages.

Firstly, the receiver may be installed on the floor without necessitating shaping of the slab, which on the one hand reduces the cost of the installation and on the other hand makes it possible to position it anywhere, regardless of the nature of the slab.

The shape adopted for the outlet pipe 3 ensures a limited overall size of features disposed at a level lower than that of the bottom of the receiver and makes it possible for said bottom to be very close to the floor.

The pumping device 2 is enclosed in a casing and no electrical conductor can come into contact with the water either in said casing 25 or in the receiver 1.

This safety feature allows the pumping device 2 to be supplied with power at the mains voltage without necessitating the use of a costly safety transformer.

In the embodiment represented in the drawings, the recess 120 for fitting the pumping device 2 is shown in a corner of the receiver, but any other location may of course be chosen.

The invention claimed is:

1. A shower installation, comprising:

a shower receiver, the shower receiver consisting overall of a first part forming a shower tray and a second part consisting of a recess; and wherein the receiver has a bottom and an inner rim raised relative to the bottom, said inner rim extending along an internal perimeter of the receiver, the recess being delimited by a wall disposed above the inner rim of the receiver so that water present in the tray cannot pass over said wall and enter the recess a pumping device, said pumping device being disposed in said recess of said receiver and in a casing closed by a lid, wherein the tray includes a cup, the bottom of which cup is at a lower level than the bottom of said tray and which cup is connected to the casing of the pumping device by a first outlet pipe conveying water present in said tray to the casing, and wherein the pumping device comprises a pressure switch having a membrane that is deformable under pressure and a second outlet pipe for discharging water, the pressure-sensitive switch being configured so that the membrane is deformed and commands a supply of electrical power to the pump when a level of water, that is fed into the casing and rises, exceeds a prescribed threshold value.

2. The shower installation as claimed in claim 1, wherein said first outlet pipe consists of an outlet of the cup of the tray connected by a sleeve to an inlet of the casing.

3. The shower installation as claimed in claim 1, wherein the first outlet pipe is disposed between the tray and the casing of the pumping device.

4. The shower installation as claimed in claim 3, wherein said first outlet pipe is of oblong section consisting of two parallel rectilinear sides connected by rounded ends, the first outlet pipe having two plane faces constituting each the larger dimension of said first outlet pipe and two curved faces constituting each the smaller dimension of said first outlet pipe, said first outlet pipe being positioned with its smaller dimension perpendicular to the floor.

5. The shower installation as claimed in claim 1, wherein the recess is closed by the lid.

6. The shower installation as claimed in claim 1, wherein the lid closing the recess bears on the inner rim of the receiver.

7. The shower installation as claimed in claim 6, wherein the lid closing the recess has a lateral wall that is positioned at a distance from the wall delimiting the recess so as to leave a gap, thereby removing a risk of water getting between the wall delimiting the recess and the lateral wall of the lid closing the recess.

8. The shower installation as claimed in claim 5, wherein the lid closing the recess bears on the inner rim of the receiver.

9. The shower installation as claimed in claim 8, wherein the lid closing the recess has a lateral wall that is positioned at a distance from the wall delimiting the recess so as to leave a gap, thereby removing a risk of water getting between the wall delimiting the recess and the lateral wall of the lid closing the recess.

10. The shower installation as claimed in claim 1, wherein the casing of the pumping device is fitted with feet for damping vibrations occurring during operation of said pumping device.

11. The shower installation as claimed in claim 10, wherein the cup has an edge on which is placed a grille so as to prevent the passage of elements other than water from the tray to the cup.

* * * * *